US008741410B2

(12) United States Patent
Cattacin et al.

(10) Patent No.: US 8,741,410 B2
(45) **Date of Patent: *Jun. 3, 2014**

(54) MANUFACTURING METHOD AND SYSTEM AND ASSOCIATED ROLLS OF SHEETS WITH ALTERNATING CUTS AND PRE-CUTS

(71) Applicant: Georgia-Pacific Consumer Products LP, Atlanta, GA (US)

(72) Inventors: Gilles Cattacin, Colmar (FR); Yves Enggasser, Biescheim (FR); Jean-Louis Neveu, Peymeinade (FR)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/632,501

(22) Filed: Oct. 1, 2012

(65) Prior Publication Data

US 2013/0040089 A1 Feb. 14, 2013

Related U.S. Application Data

(63) Continuation of application No. 12/513,004, filed as application No. PCT/FR2007/001737 on Oct. 22, 2007, now Pat. No. 8,298,640.

(30) Foreign Application Priority Data

Oct. 31, 2006 (FR) ..... 06 09546

(51) Int. Cl.
*A47K 10/16* (2006.01)

(52) U.S. Cl.
USPC ..... 428/43

(58) Field of Classification Search
USPC ..... 428/43
See application file for complete search history.

(56) References Cited

U.S. PATENT DOCUMENTS

| | | | |
|---|---|---|---|
| 390,328 | A | 10/1888 | Wheeler |
| 400,913 | A | 4/1889 | Hicks |
| 453,003 | A | 5/1891 | Hicks |
| 495,516 | A | 9/1891 | Wheeler |
| 511,983 | A | 1/1894 | Wheeler |
| 607,498 | A | 7/1898 | Wheeler |
| 2,007,544 | A | 7/1935 | Meisel |

(Continued)

FOREIGN PATENT DOCUMENTS

| | | | |
|---|---|---|---|
| DE | 20107189 | U1 | 7/2001 |
| DE | 20314147 | U1 | 12/2003 |

(Continued)

OTHER PUBLICATIONS

International Preliminary Report on Patentability Chapter *, dated May 5, 2009 for PCT/FR2007/001737; 8 pages.

(Continued)

*Primary Examiner* — Alexander Thomas
(74) *Attorney, Agent, or Firm* — William W. Letson

(57) ABSTRACT

A roll includes a succession of sheets of single-use absorbent paper, the succession of sheets includes a first sheet partially defined by a first line of perforations and a first cut arrangement partially defined by a first cut, a second cut, and a connecting region arranged between the first cut and the second cut and a second sheet partially defined by the first cut arrangement, and a second line of perforations.

16 Claims, 5 Drawing Sheets

(56) References Cited

U.S. PATENT DOCUMENTS

| | | | | |
|---|---|---|---|---|
| 2,053,786 | A | 9/1936 | Straubel | |
| 2,328,109 | A | 8/1943 | Thompson | |
| 3,276,706 | A | 10/1966 | House | |
| 3,326,365 | A | 6/1967 | Neureither et al. | |
| 3,570,335 | A | 3/1971 | Marin | |
| 3,845,289 | A | 10/1974 | French | |
| 3,877,576 | A | 4/1975 | Kishi et al. | |
| 4,134,521 | A | 1/1979 | Pecht | |
| 4,236,679 | A | 12/1980 | Jespersen | |
| 4,317,547 | A | 3/1982 | Graham, Jr. et al. | |
| 4,378,912 | A | 4/1983 | Perrin et al. | |
| 4,403,748 | A | 9/1983 | Cornell | |
| 4,457,964 | A | 7/1984 | Kaminstein | |
| 4,521,209 | A | 6/1985 | DuFresne | |
| 4,552,315 | A | 11/1985 | Granger | |
| 4,627,117 | A | 12/1986 | Morishita | |
| 4,648,530 | A | 3/1987 | Granger | |
| 4,651,895 | A | 3/1987 | Niske et al. | |
| 4,753,369 | A | 6/1988 | Morrison | |
| 4,756,485 | A | 7/1988 | Bastian et al. | |
| 4,807,824 | A | 2/1989 | Gains et al. | |
| 4,846,412 | A | 7/1989 | Morand | |
| 4,856,724 | A | 8/1989 | Jespersen | |
| 4,905,868 | A | 3/1990 | Beane et al. | |
| 4,944,466 | A | 7/1990 | Jespersen | |
| 5,205,454 | A | 4/1993 | Schutz et al. | |
| RE34,288 | E | 6/1993 | Beck et al. | |
| 5,244,161 | A | 9/1993 | Wirtz-Odenthal | |
| 5,496,605 | A | 3/1996 | Augst et al. | |
| 5,526,973 | A | 6/1996 | Boone et al. | |
| 5,582,362 | A | 12/1996 | Johnson et al. | |
| 5,704,566 | A | 1/1998 | Schutz et al. | |
| 5,785,274 | A | 7/1998 | Johnson | |
| 5,836,862 | A | 11/1998 | Granger | |
| 5,979,822 | A | 11/1999 | Morand et al. | |
| 6,010,090 | A | 2/2000 | Johnson | |
| 6,059,711 | A | 5/2000 | Wang | |
| 6,090,467 | A | 7/2000 | Yip | |
| 6,109,473 | A | 8/2000 | Neveu et al. | |
| 6,145,779 | A | 11/2000 | Johnson et al. | |
| 6,145,782 | A | 11/2000 | King et al. | |
| 6,152,397 | A | 11/2000 | Purcell | |
| 6,228,454 | B1 | 5/2001 | Johnson et al. | |
| 6,237,871 | B1 | 5/2001 | Morand et al. | |
| 6,440,052 | B1 | 8/2002 | Reider et al. | |
| 6,447,864 | B2 | 9/2002 | Johnson et al. | |
| 6,460,727 | B1 | 10/2002 | Irwin | |
| 6,464,120 | B1 | 10/2002 | Johnson et al. | |
| 6,536,624 | B2 * | 3/2003 | Johnson et al. | 221/45 |
| 6,581,500 | B1 | 6/2003 | Kietaibl | |
| 6,622,888 | B2 | 9/2003 | Boone et al. | |
| 6,736,348 | B1 | 5/2004 | Formon et al. | |
| 6,826,991 | B1 | 12/2004 | Rasmussen | |
| 6,860,447 | B2 | 3/2005 | Boone et al. | |
| 6,874,653 | B2 | 4/2005 | Boone et al. | |
| 6,884,209 | B2 | 4/2005 | Roozrokh | |
| 6,889,970 | B2 | 5/2005 | Takahashi et al. | |
| 6,892,898 | B1 | 5/2005 | Boone et al. | |
| 6,959,885 | B2 | 11/2005 | King | |
| 6,964,395 | B1 | 11/2005 | Lewis et al. | |
| 7,137,539 | B2 | 11/2006 | Jackson | |
| 7,168,602 | B2 | 1/2007 | Broehl | |
| 7,234,610 | B2 | 6/2007 | Skarda et al. | |
| 7,370,826 | B2 | 5/2008 | Neveu | |
| 7,416,162 | B2 | 8/2008 | Behroozi | |
| 7,832,678 | B2 | 11/2010 | Hjort et al. | |
| 7,837,077 | B2 | 11/2010 | Formon et al. | |
| 7,954,405 | B2 | 6/2011 | Kling | |
| 7,967,235 | B2 | 6/2011 | Forman et al. | |
| 7,971,514 | B2 | 7/2011 | Alalu | |
| 8,298,640 | B2 * | 10/2012 | Cattacin et al. | 428/43 |
| 2005/0067519 | A1 | 3/2005 | King | |
| 2007/0098944 | A1 | 5/2007 | Mitchell, Jr. | |
| 2008/0173661 | A1 | 7/2008 | Neveu | |
| 2008/0197142 | A1 | 8/2008 | Langen et al. | |
| 2008/0280088 | A1 | 11/2008 | Baum | |
| 2009/0155512 | A1 | 6/2009 | Neto et al. | |
| 2010/0114366 | A1 | 5/2010 | Case et al. | |
| 2010/0224647 | A1 | 9/2010 | Formon et al. | |
| 2011/0139920 | A1 | 6/2011 | Formon et al. | |
| 2011/0168831 | A1 | 7/2011 | Mok et al. | |
| 2011/0177278 | A1 | 7/2011 | Neto et al. | |
| 2011/0210137 | A1 | 9/2011 | Kling | |
| 2011/0226883 | A1 | 9/2011 | Forman et al. | |
| 2012/0138625 | A1 | 6/2012 | Case et al. | |
| 2012/0237711 | A1 | 9/2012 | Cattacin et al. | |

FOREIGN PATENT DOCUMENTS

| | | | |
|---|---|---|---|
| EP | 865247 | B1 | 3/2002 |
| EP | 0930039 | B1 | 11/2002 |
| EP | 1230886 | B1 | 12/2004 |
| EP | 1232715 | B1 | 11/2005 |
| EP | 1231823 | B1 | 8/2006 |
| FR | 2761252 | A1 | 10/1998 |
| FR | 2873562 | A1 | 2/2006 |
| GB | 2377204 | A | 1/2003 |
| JP | 2003-144344 | A | 5/2003 |
| JP | 2005-065730 | A | 3/2005 |
| JP | 2009-039226 | A | 2/2009 |
| WO | 9721377 | A1 | 6/1997 |
| WO | 98/37794 | A1 | 9/1998 |
| WO | 2006007256 | A1 | 1/2006 |
| WO | 2008056042 | A2 | 5/2008 |

OTHER PUBLICATIONS

International Search Report for PCT/FR2007/001737; dated Oct. 31, 2008; 8 pages.

Office Action—Advisory Action for U.S. Appl. No. 12/513,004, filed Apr. 30, 2009; Gilles Cattacin; Mailing Date: Oct. 24, 2011; 3 pages.

Office Action—Final for U.S. Appl. No. 12/513,004, filed Apr. 30, 2009; Gilles Cattacin; Mailing Date: Jul. 6, 2011; 9 pages.

Office Action—Advisory Action for U.S. Appl. No. 12/513,004, filed Apr. 30, 2009; Gilles Cattacin; Mailing Date: Mar. 6, 2012; 3 pages.

Office Action—Non-Final for U.S. Appl. No. 12/513,004, filed Apr. 30, 2009; Gilles Cattacin; Mailing Date: Mar. 3, 2011; 9 pages.

Written Opinion of the International Search Authority for PCT/FR2007/001737; mailed Oct. 31, 2008; 7 pages.

International Search Report and the Written Opinion of the International Search Authority for PCT/US2013/025334 mailed May 15, 2013.

* cited by examiner

MANUFACTURING METHOD AND SYSTEM AND ASSOCIATED ROLLS OF SHEETS WITH ALTERNATING CUTS AND PRE-CUTS

CROSS-REFERENCE TO RELATED APPLICATIONS

This is a continuation of U. S. Pat. No. 8,298,640 B2, filed Apr. 30, 2009, which is the national stage entry of International Application No. PCT/FR2007/001737, filed Oct. 22, 2007, which claims priority to French Application No. 06 09546, filed Oct. 31, 2006, the disclosures of which are incorporated in their entireties herein by reference.

BACKGROUND

The present invention relates to rolls of single-use paper such as bathroom tissue and paper towels for away from home or private use.

In the field of disposable or tissue paper, there are basically two types of apparatus for dispensing the paper sheets and therefore two ways of presenting the paper: in folded and/or interleaved sheets, and in rolls.

As regards roll dispensers, the prior art includes centrally unwound dispensers in which the paper is extracted from the dispenser via the axis (or centre) of the roll. The dispenser in these cases generally has an opening or cone situated close to the axis of the roll. The unwinding axis can be horizontal, as disclosed for example in French Patent Application FR 2 873 562 filed in the applicant's name; another illustration is provided by application WO 2006/007256.

Centrally unwound rolls in which the unwinding axis is vertical are also known: application FR 2 761 252 is an example of this, as is application WO 97/21377.

Patent US 2005/0067519 is also known which describes a dispenser of this type containing a double-winding roll with staggering of the lines of pre-cuts.

One or other of the solutions will be envisaged depending on the use and/or the amount of space available for the dispenser.

As it comes out of such dispensers, the paper is generally crumpled in the dispensing cone.

Also known are the so-called tangentially unwound dispensers in which the rolls are unwound by free rotation about their axis, the paper being extracted through a slot or opening close to a generatrix of the roll.

The individual sheets or pieces making up the rolls may be connected to each other by pre-cuts. It is also known practice to have a tool built into the dispenser to cut the sheets when a length of one sheet has been unwound by the user.

In a simpler form, another type of dispenser allows the user to cut a piece himself, by, for example, a cutting blade positioned at the outlet of the paper.

Preferably, but not exclusively, the present invention relates to tangentially unwound rolls.

U.S. Pat. No. 459,516 discloses similar rolls in which the sheets include transverse cuts extending at regular intervals across virtually the entire width of the roll.

One or two joins per width of the roll connect the sheets and are offset across the width of the roll.

Document DE 203 14147 discloses a paper web comprising transverse cuts at regular intervals associated with at least one connecting region.

Also known is document DE 201 07189 which discloses a roll of bathroom tissue or the like, in which the sheet has, at regular intervals across its width, an alternation of small and large pre-cuts.

Also known, from Patent U.S. Pat. No. 4,627,117, is a roll of paper for covering toilet seats, in which one of the variants of the wound sheet has an alternation of continuous perforations and discontinuous perforations (the central region in this case having neither perforations nor cuts). On cutting such a sheet at the continuous perforations only, the user can thus cover one half of a toilet seat by folding the sheet against the seat using the so-called discontinuous perforations.

Another issue which arises in the away from home use of such rolls is the importance of being able to control the consumption of paper and limit it in order to reduce the cost of use.

Roll dispensers, whether of the central or tangential unwinding variety, have a problem of overconsumption in away from home use because the individual sheets (or pieces) are connected to each other by perforations and connecting regions, and it is up to the user to decide freely the number of sheets (or pieces) he extracts and cuts before use; and he generally extracts and uses a very great length of paper.

As mentioned above, one way of solving this problem is to feed out a predetermined limited length of paper. This necessitates a mechanical system more or less complex, and Patent EP 0 930 039 is an example of this type of dispenser.

Recently, electrical and/or electronic components have made it possible to control and limit the amount of paper unwound in laterally unwound dispensers: patents EP 1 230 886, EP 1 231 823 and EP 1 232 715 protect different aspects of recent electronic dispensers with electronic paper dispensing control.

These systems certainly solve the problem of how to control the amount dispensed but their drawback is that they are more or less sophisticated and therefore expensive and/or fragile in use, which can make them un-appropriate for away from home use.

Other (practical) uses require rolls of disposable paper to be unwound and cut in a controlled manner.

In all cases there exists a need for a simple, reliable system for dispensing initially wound sheets (or pieces), or rather for a roll which will perform this function itself.

Rolls in which the sheets are cut at regular intervals are also known: patent U.S. Pat. No. 2,053,786 is an example.

SUMMARY

The subject of the present invention is a roll including a succession of sheets (or pieces) of absorbent paper separated along one of their sides perpendicular to the roll-unwinding direction by mutually parallel pre-cuts.

According to the invention, the sheets are also separated by cuts, the cuts and pre-cuts alternating in the roll-unwinding direction.

In this way, by unwinding the roll, the user can easily remove a ready-cut piece of paper comprising several pieces joined together by pre-cuts, and do so with the application of a single very weak pulling force on the free end of the roll.

The user can also remove one or two pieces only, connected by pre-cuts, if he wishes.

In a preferred embodiment of the invention, the cuts extend along at least 80% and preferably along more than 93% of the cut side of the sheets.

Advantageously, the cuts are produced in such a way as to leave at least one connecting region situated for example at one end of the cut side; the connecting region or regions may be situated in the central region of the cut side, and/or between the central region and either extremity of the sheet.

These connecting regions, which may be a few millimetres long for example, enable the user to slightly free the end of a sheet (or piece) when the previous sheet is pulled, and then when the said piece is cut by the pulling action of the user.

In one particular embodiment of the invention, an alternation of at least one pre-cut line with a cut line occurs in the length in which the roll is unwound.

In one useful embodiment of the invention, the roll comprises a winding of at least two sheets superposed one on top of the other in such a way that the cuts of one of the sheets are staggered lengthwise relative to the cuts of another immediately superposed sheet.

This stagger means that, when one of the sheets is pulled off, the second sheet is in an almost unwound position and can more easily be grasped and pulled off . . . and so on.

The invention also relates to a method of manufacturing rolls of sheets of absorbent paper comprising in particular a stage of pre-cutting of the sheets, the method being one also includes making cuts at right angles to the direction of unwinding of each roll, alternating with and parallel to the said pre-cuts.

More specifically, a succession of cuts and pre-cuts is made along a generatrix of the cutting tool at right angles to the roll-unwinding direction and before the sheets are wound up to form logs.

In one embodiment of the invention, the method includes producing a path of different length for the sheets after the formation of the pre-cuts and/or cuts and before the said sheets are superposed, in order to create a lengthwise staggering of the cuts between two immediately superposed sheets.

The invention also relates to a system for manufacturing rolls of absorbent sheets, comprising a unit for cutting and pre-cutting sheets into pieces, the said unit comprising a rotating element on which are mounted several knives having specific cutting profiles spaced out at angular intervals around the rotating element and acting in conjunction with a fixed anvil, the cutting profile of at least one of the knives having at least one cutting region and at least one pre-cutting region.

More precisely, the cutting profiles of two successive knives are such that the cutting regions and pre-cutting regions are staggered along the axis of the rotating element.

Advantageously, the cutting profiles of two successive knives are such that the cutting regions have an overlap along the axis of the rotating element.

BRIEF DESCRIPTION OF THE DRAWINGS

Other features, details and advantages of the invention will be made more apparent by the following description, which is offered as a purely non-restrictive illustration with reference to the attached drawings, in which.

DETAILED DESCRIPTION

Figure 1:
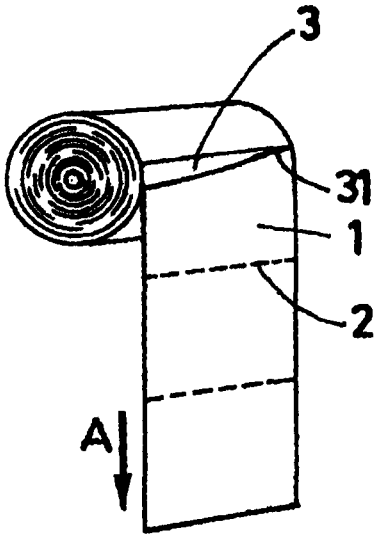
FIG. 1 is a diagram of a roll in one embodiment of the invention.

In FIG. 1, a roll according to the invention, in this case a tangentially unwound roll, i a succession of sheets or pieces 1 separated along one side by mutually parallel pre-cuts 2. The side in question is perpendicular to the roll-unwinding direction indicated by the arrow A.

As in the prior art, "pre-cuts" means an in-line alternation of connecting regions and cuts whose size and alternation may vary to suit the envisaged use.

According to the invention, the said sheets 1 are also separated by cuts 3 extending most of the way across at least one of their sides and parallel to the pre-cuts.

"Most" usually means more than 50%, and here preferably at least 80% of the side of the sheet 1 and more preferably more than 93% of the said side.

The remaining length or connecting region 31, which is basically uncut, serves as a connection between the sheets 1 or series of sheets, and can easily be torn by the user. "Connecting region" here means an uncut region formed either by a single join or by several joins close together.

Thus, by pulling and more or less simultaneously tearing at least one connecting region 31, the user frees the end of the next sheet from the roll, so that it is easy to grasp.

Additionally, the connecting region or regions 31 prevent the already unwound sheet from falling to the ground if the user does not hold it.

Without implying any restriction, the connecting region or regions 31 may be situated at at least one end of the cut 3 and/or in the central region of the cut 3, and/or between these regions.

Figure 2:
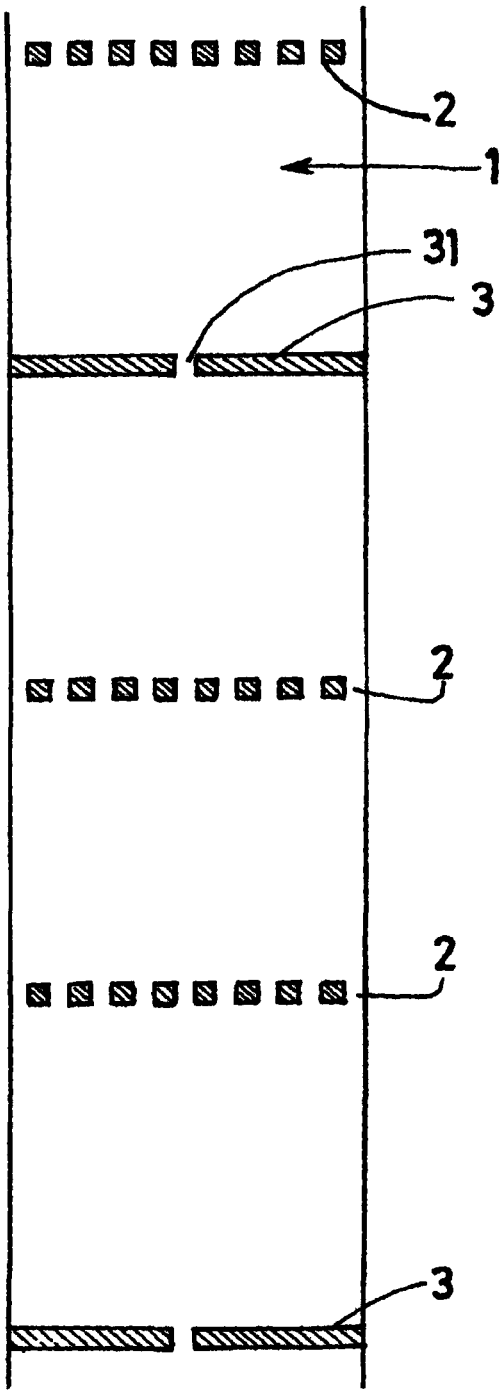
FIG. 2 is an example of an embodiment of a roll according to the invention.

FIG. 2 shows a connecting region 31 located in the middle of the cut 3.

This figure also illustrates an embodiment in which a cut alternates with two pre-cuts 2. This defines an alternation of order 2, namely one cut 3 alternating with two pre-cuts 2. Many other combinations may be envisaged; an alternation of order 1 or order 3 or higher for the cuts and pre-cuts are to be regarded as part of the invention.

Figure 3:
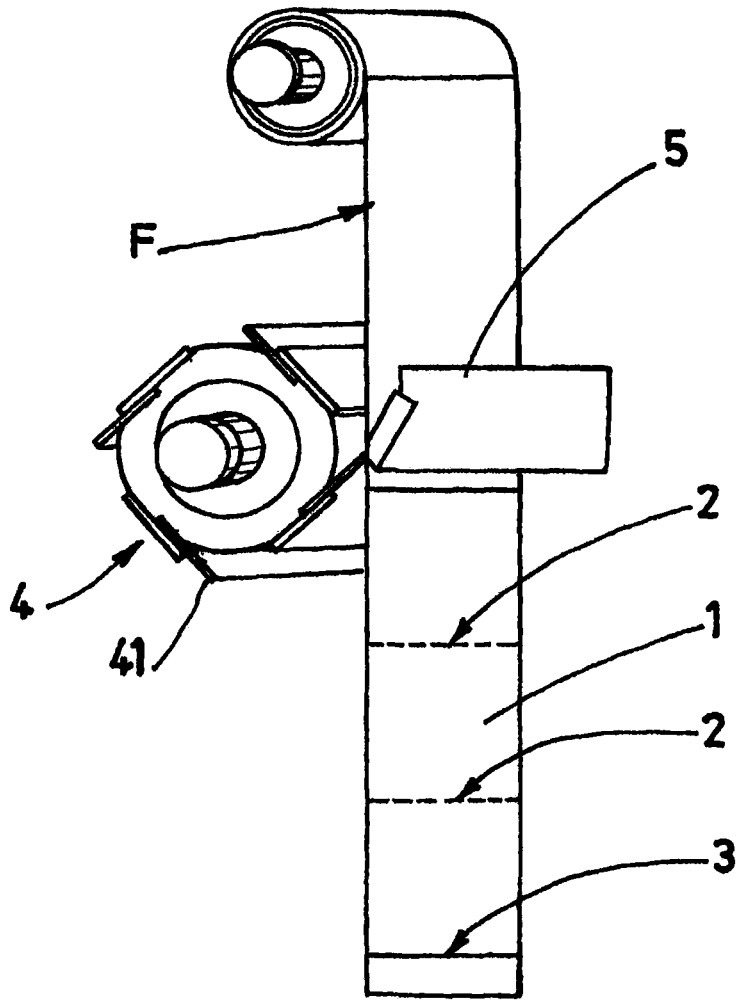
FIG. 3 is a diagram showing the essential elements and features of a system for carrying out the invention.

In order to produce this type of roll industrially, it is envisaged that, as illustrated in FIG. 3, at least one sheet be fed between a rotating element 4 on which several knives 41 are mounted, and a fixed anvil knife 5.

As in the prior art, the anvil knife 5 is a fixed profiled element designed to withstand the pressure exerted by each knife 41 as it passes it.

The rotating element 4 is a cylindrical part in which knives 41 are held and mounted and from which they project parallel to the generatrices of the cylinder 4, as shown in FIG. 3.

FIG. 3 shows four knives 41 in a non-restrictive example. Clearly, this number may differ according to requirements and/or the applications envisaged and/or the configuration of the machines employed.

Figure 4:
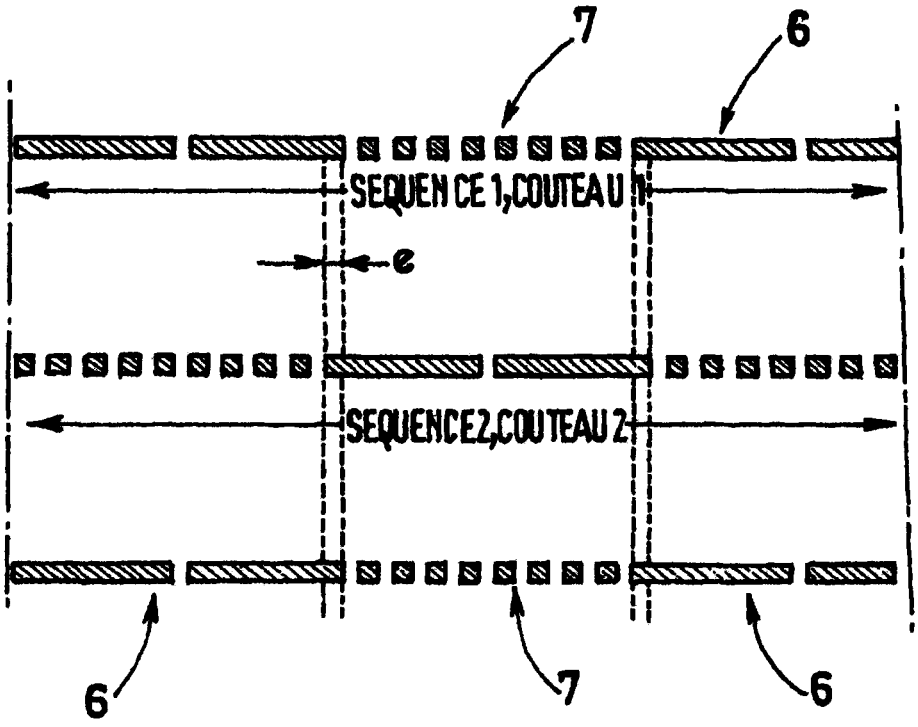
FIG. 4 is a diagram of the profiles of several knives arranged in succession.

Additionally, as illustrated schematically in FIG. 4, each knife 41 has a specific cutting profile.

More precisely, each knife 41 extends longitudinally across a width of the sheet to be processed.

At this stage of the manufacture, the sheet to be processed is in many cases several metres wide. It is then wound up on itself to form a log which is then cut lengthwise into several sections which are the final rolls obtained and which, for the bathroom tissue application, are commonly approximately 100 mm wide. For information, the best-known rolls of paper towels are approximately 210 mm in width.

In another embodiment, the log may be cut at right angles to its axis (and hence along the winding direction) at the same time as it is being wound.

Each knife 41 has a cutting profile comprising at least one solid cutting region 6 and one pre-cutting region 7 across the width of the sheet F to be processed.

The solid cutting region 6 is staggered longitudinally from one knife 41 to the next, as are the pre-cutting regions 7.

The solid cutting region 6 preferably corresponds approximately to the width of a final roll; in practice it is slightly longer as explained below.

Moreover, the profiles of the successive knives 41 are such that the solid cutting regions 6 overlap by a length "e" (measured along the axis of the roll) from one knife to the next.

This allows greater tolerance when setting the cut either of the logs or of the sheets themselves if in-line cutting is adopted. This ensures that each roll is cut off cleanly and neatly.

FIG. 4 shows diagrammatically an example of a number of knife profiles and their sequencing. More explicitly, one of the knives (called knife 1) here comprises a cutting region 6 at one end, which alternates with a pre-cutting region 7 along the rest of its length. The second knife (knife 2) comprises, level with the cutting region 6 of knife 1, a pre-cutting region followed by a cutting region 6 of the same length as that of knife 1, then again a pre-cutting region 7 . . . and so on.

In the embodiment shown in FIG. 4, the third knife has the same profile and is set axially in the same way as knife 1.

This specific and characteristic arrangement thus makes it possible to produce on each of the sheets forming a roll an alternation of cuts 3 and pre-cuts 2.

Other sequences may of course be devised without departing from the spirit of the invention.

For example, some of the knives 41 may comprise pre-cutting blades only, as is conventional. It is the combination and the particular sequence of knives 41 of different profiles mounted on the rotating element 4 and acting successively in conjunction with the fixed anvil 5, which makes it possible to realize the subject of the invention in a manner that is at once novel, simple, easy to carry out and unexpected.

Figure 5:
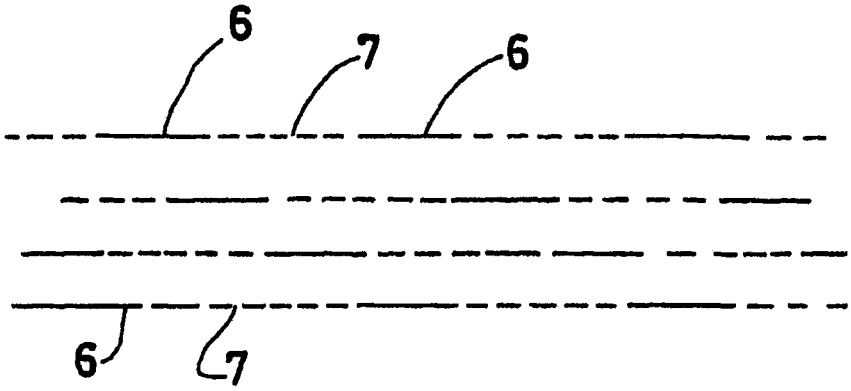
FIGS. 5 and 6 are diagrams of two sequences of cuts and pre-cuts according to the invention.

FIG. 5 shows sequences of cuts and pre-cuts which are identical on the four knives but staggered along the axis of the rotating element 4.

Figure 6:
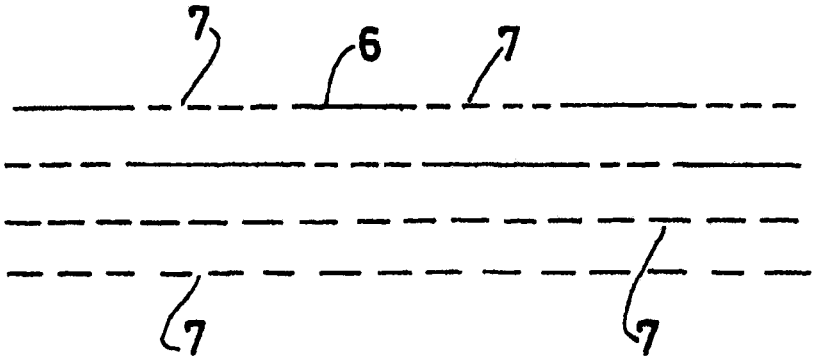

In FIG. 6, two consecutive knives exhibit alternating solid 6 and pre-cutting 7 regions, while the next two knives produce only pre-cuts all the way across the width of the sheet to be processed.

A person skilled in the art will select the most appropriate sequence to suit the type of paper to be processed, and/or to suit the desired application.

In the sheets, the pre-cuts 2 may have differing and varying percentages of connecting regions; a person skilled in the art will select these within the scope of the invention. As such, an embodiment may include pre-cuts 2 where the lengths and arrangement of the cuts in the first pre-cut 2 is dissimilar from the lengths and arrangement of the cuts in the second pre-cut 2. Furthermore, a pre-cut 2 may include a cut having a first length and another cut having a second length that is different from the first length. The pre-cut 2 may include a connecting region having a first length and another connecting region having a second length that is different from the first length.

Figure 7:
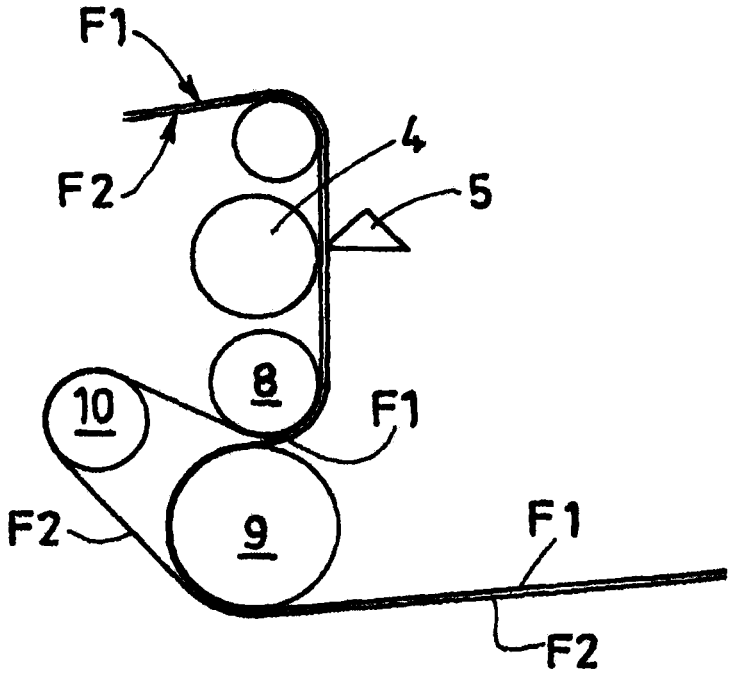
FIG. 7 is a diagram of an embodiment of an installation according to the invention.
Figure 8:
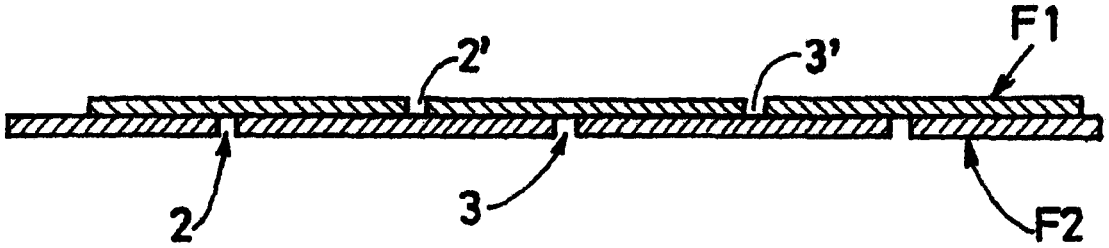
FIG. 8 is a cross section through a sheet produced in one embodiment of the invention.

Furthermore, in accordance with the diagrams of FIGS. 7 and 8, where the roll includes a winding of two or more superposed sheets, in this case two sheets F1 and F2, it is conceivable according to the invention to run each of the sheets along paths of different lengths after the stage of forming the cuts and pre-cuts.

More specifically, after their simultaneous passage between the rotating element 4 and the anvil knife 5, the sheets F1, F2 follow different paths: sheet F1 passes around a first cylinder 8 and then around a second, guiding cylinder 9, while sheet F2 passes around the first cylinder 8 and then around a detour cylinder 10, before being superposed on the first sheet F1 as it passes the second cylinder 9.

The effect is that the cuts 3, 3' and pre-cuts 2, 2' of the two sheets F1, F2 are staggered in the lengthwise direction, as illustrated in FIG. 8. They are wound up in this way to form the rolls according to the invention.

As a result, when the user pulls on a free end of a sheet of a roll it will be one of the sheets, F1 for example, which comes away from the roll while the other sheet F2 is still retained in the winding.

This has the advantage of ensuring that one sheet is always ready to be grasped by the user, conveniently unwound from the roll and yet partially retained in the winding.

Without departing from the scope of the invention, the cuts 3, 3' can be formed across the full width of the roll, in which case the alternation with the pre-cuts allows a momentary hold by contact against part of the outer surface of the roll, whereupon one or more sheets separated by pre-cuts are able to detach themselves from the roll.

What is claimed is:

1. A roll comprising a succession of sheets of single-use absorbent paper, the succession of sheets comprising:

a first sheet partially defined by:

a first in-line alternation of connecting regions and cuts; and a cut arrangement partially defined by a first cut, a second cut, and a connecting region arranged between the first cut and the second cut, the first cut and the second cut extending a length greater than 50% of a width of the succession of sheets; and a second sheet partially defined by:

the cut arrangement; and a second in-line alternation of connecting regions and cuts;

wherein the first in-line alternation of connecting regions and cuts includes a first connecting region having a first length and a second connecting region having a second length, the first length is greater than the second length.

2. The roll of claim 1, wherein the succession of sheets is partially defined by a first side and a second side, the first side parallel to the second side, and wherein the first cut of the cut arrangement intersects the first side.

3. The roll of claim 2, wherein the second cut of the cut arrangement intersects the second side.

4. The roll of claim 2, wherein the first cut of the cut arrangement is arranged substantially perpendicular to the first side and the second cut of the cut arrangement are arranged substantially perpendicular to the second side.

5. The roll of claim 1, wherein the first in-line alternation of connecting regions and cuts includes a plurality of connecting regions and a plurality of cuts.

6. The roll of claim 1, wherein the first in-line alternation of connecting regions and cuts includes a cut having length greater than a length of one of the connecting regions.

7. The roll of claim 1, wherein the first in-line alternation of connecting regions and cuts includes a cut having length less than a length of one of the connecting regions.

8. The roll of claim 1, wherein the first in-line alternation of connecting regions and cuts includes a first cut having a first length and a second cut having a second length, the first length is greater than the second length.

9. The roll of claim 1, wherein the first in-line alternation of connecting regions and cuts is arranged substantially perpendicular to a roll-unwinding direction.

10. The roll of claim 1, wherein the second in-line alternation of connecting regions and cuts includes a plurality of connecting regions and a plurality of cuts.

11. The roll of claim 1, wherein the second in-line alternation of connecting regions and cuts includes a cut having length greater than a length of one of the connecting regions.

12. The roll of claim 1, wherein the second in-line alternation of connecting regions and cuts includes a cut having length less than a length of one of the connecting regions.

13. The roll of claim 1, wherein the second in-line alternation of connecting regions and cuts includes a first cut having a first length and a second cut having a second length, the first length is greater than the second length.

14. The roll of claim 1, wherein the second in-line alternation of connecting regions and cuts includes a first connecting region having a first length and a second connecting region having a second length, the first length is greater than the second length.

15. The roll of claim 1, wherein the first in-line alternation of connecting regions and cuts is arranged substantially perpendicular to a roll-unwinding direction.

16. The roll of claim 1, further comprising a winding of at least two sheets superposed one on top of the other such that the cuts of one of the sheets are staggered lengthwise relative to the cuts of another immediately superposed sheet.

* * * * *